United States Patent [19]

Schoch

[11] Patent Number: 4,480,395

[45] Date of Patent: Nov. 6, 1984

[54] CLOSURE FOR SHOES, ESPECIALLY SKI BOOTS

[75] Inventor: Robert Schoch, Hilzingen, Fed. Rep. of Germany

[73] Assignees: Weinmann GmbH & Co. KG; Fahrrad-und Motorrad-Teilefabrik Im Haselbusch, both of Fed. Rep. of Germany

[21] Appl. No.: 440,836

[22] Filed: Nov. 12, 1982

[30] Foreign Application Priority Data

Dec. 8, 1981 [DE] Fed. Rep. of Germany ..... 3148527

[51] Int. Cl.[3] ..... A43B 11/00

[52] U.S. Cl. ..... 36/50; 24/68 SK; 24/68 B; 24/19

[58] Field of Search ..... 36/50; 24/68 B, 68 SK, 24/69 SK, 70 SK, 71 SK, 117, 119, 19, 70 R, 70 CT, 70 TT, 70 ST, 71.1, 70 J

[56] References Cited

U.S. PATENT DOCUMENTS

| | | | |
|---|---|---|---|
| 3,738,027 | 6/1973 | Schoch | 36/50 |
| 3,808,644 | 5/1974 | Schoch | 36/50 |
| 4,115,904 | 9/1978 | Zwyssie et al. | 24/68 J |
| 4,433,456 | 2/1984 | Baggio | 36/50 |

FOREIGN PATENT DOCUMENTS

| | | | |
|---|---|---|---|
| 228946 | 6/1880 | Fed. Rep. of Germany | 24/68 SK |
| 2900077 | 7/1980 | Fed. Rep. of Germany | 36/50 |
| 23737 | of 1914 | United Kingdom | 24/68 B |
| 201349 | 8/1923 | United Kingdom | 24/68 B |

*Primary Examiner*—Werner H. Schroeder
*Assistant Examiner*—Steven N. Meyers
*Attorney, Agent, or Firm*—Learman & McCulloch

[57] ABSTRACT

A shoe closure intended particularly for ski boots contains two pull straps adapted to be fastened on corresponding parts of the shoe and a rotatable actuating member with two driving members arranged eccentrically with reference to the axis of rotation of the actuating member. The ends of the pull straps which face each other have only half the width of the remainder of the straps and are located adjacent and alongside each other. Each pull strap has a groove which is open toward the other pull strap, the depth of such groove corresponding to the eccentricity of the driving members, and the driving members engage in the groove so that a largely direct and effective and closing is made possible in a simple manner.

10 Claims, 4 Drawing Figures

CLOSURE FOR SHOES, ESPECIALLY SKI BOOTS

BACKGROUND OF THE INVENTION

The invention relates to a closure for shoes, especially ski boots, comprising two straight pull straps intended for connection to parts of the shoe and a rotatable actuating member which has two engaging pieces arranged eccentrically with reference to the axis of rotation of the actuating member.

In a known construction of the type described above (see German Pat. No. 20 46 890) the actuating member is connected to the pull straps by means of a type of Maltese cross drive and by means of hinged pull rods in such a way that when the actuating member is rotated in one direction the pull straps are pulled up and thus the parts of the leg of the boot which are firmly connected to the pull straps are pulled together, whereas when the actuating member is rotated in the other direction the pull straps and the parts of the leg of the boot connected thereto are pushed apart and thus the boot is opened.

SUMMARY OF THE INVENTION

An object of this invention is to develop a closure of the general type referred to and which is distinguished by a particularly simple construction, by its effective adjustability, and by a particularly good fit at various points on a shoe, especially a ski boot.

This object is achieved according to the invention by the following features:

(a) The pull straps have half the width at the ends thereof which face each other and are guided adjacent to each other at these ends;

(b) the ends of the pull straps each contain a groove which is open towards the other pull strap and has a depth corresponding to the eccentricity of the engaging piece;

(c) the engaging pieces of the actuating member engage in these grooves.

In this construction of the closure according to the invention the ends of the pull straps are produced with only half the width and are reciprocally guided adjacent to each other and as a result of the construction and arrangement of the grooves and the engaging pieces an essentially direct reciprocal movement of the pull straps is achieved and thus a fast, reliable and very effective opening and closing of the associated shoe. This construction also contributes to an extremely simple design of the whole closure and good adaptability thereof to appropriate parts of the shoe, predominantly the leg of the boot.

DESCRIPTION OF THE DRAWINGS

Further details of the invention are explained in the following description and illustrated in the drawings, in which.

DETAILED DESCRIPTION

Figure 1:
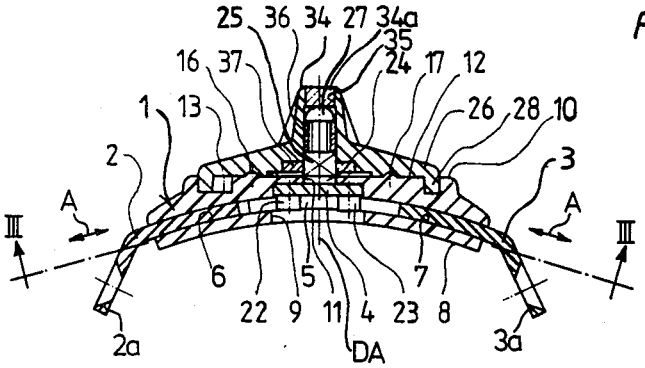
FIG. 1 is a sectional view through the closure taken on the line I—I in FIG. 2.

The closure illustrated in the drawings has a housing 1, which is preferably made from a suitable synthetic material. In this housing 1 two substantially straight pull straps 2, 3 are received, the outer free ends 2*a* and 3*a* respectively of which are to be fixed approximately on the edges of the leg or similar parts of the shoe or ski boot (not shown) which are to be pulled together. The housing has a rear wall 8 facing the shoe and within the housing 1 is a drive element in the form of a rotary drive wheel 4 accommodated in a space 5 in the central region from which two opposing guide channels 6, 7 extend as extensions of each other to both sides in a substantially straight line out of the housing 1. The cross-section of these two guide channels 6, 7 corresponds approximately to the cross-section of the two pull straps 2, 3 which are received in the guide channels 6, 7 and are reciprocally and longitudinally movable (cf. double headed arrows A). The rear wall 8 of the housing has a slightly curved shape adapted to the point at which it is to be applied to the shoe or the leg of the boot (cf. FIG. 1); the guide channels 6, 7, which are essentially cut into this rear wall 8 and the pull straps 2, 3 which are movable therein, are provided with a corresponding curvature.

On the lower surface thereof facing the ski boot the rotary drive wheel 4 has two driving members or tangs 22, 23 which project approximately in the axial direction, have a circular cross-section, and are arranged eccentrically with reference to the central axis of rotation DA of the rotary drive wheel 4 and thus of an actuating member of which the rotary drive wheel forms a part.

Figure 3:
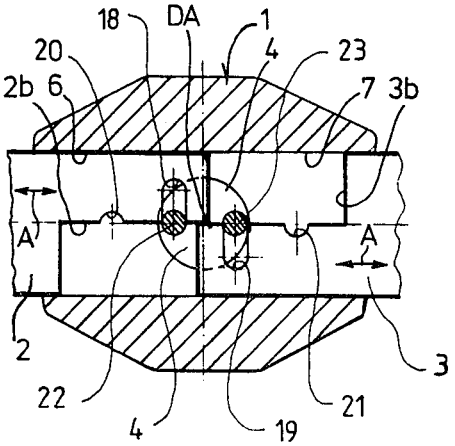
FIGS. 3 and 4 are sectional views along the line III—III in FIG. 1, one showing the open position and the other showing the closed position of the closure.
Figure 4:
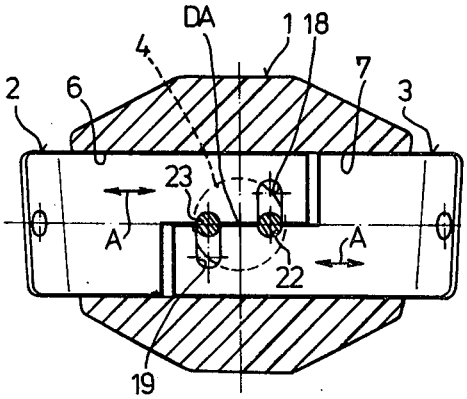

The ends of the two pull straps 2, 3 which face each other and are located inside the housing 1, see in particular FIGS. 3 and 4, are of only half width. That is, in the illustrated embodiment the free ends of the two pull straps 2, 3 which face each other have approximately rectangular limbs 2*b* and 3*b* which confront each other, and the length of such limbs (in the longitudinal direction of the pull straps) being such that these limbs always lie within the guide channels 6, 7 in all positions of the closure or the pull straps 2, 3. The ends of the pull straps provided with the limbs 2*b*, 3*b* lie adjacent to each other in such a way that they are guided so as to be longitudinally movable on the one hand on the longitudinal sides of their limbs 2*b*, 3*b* facing each other and on the other hand on the corresponding inner walls of the relevant guide channels 6, 7.

Each of the pull strap limbs 2*b*, 3*b* also has a groove 18 and 19, respectively, which is open towards the other pull strap or the opposite longitudinal edge of the other limb, the groove in this embodiment being preferably cut approximately at right angles into the corresponding longitudinal edge of the limb 2*b*, 3*b*. The depth of the groove corresponds to the eccentricity of the tangs 22, 23 on the rotary drive wheel 4 (see FIGS. 3 and 4), and the width of the groove corresponds approximately to the diameter of the relevant tang 22 or 23, the base of each groove 18, 19 being semicircular and adapted to the diameter of the tang 22, 23. The tangs of the rotary drive wheel 4 engage in the grooves 18, 19 so that a form-locking drive coupling is produced.

An opening 9 is provided in the rear wall 8 of the housing facing the shoe, while in the opposing upper wall 10 of the housing a bore 11 is provided for mounting the rotary drive wheel 4. The upper housing wall 10 has a substantially flat upper surface 12 with a circular groove 13 formed in it. Accommodated in the groove 13 is a circular projecting rim 28 of a rotary actuating knob 26 arranged on the upper housing wall 10 which, as will be described in greater detail, is fastened with the rotary drive wheel 4. The external diameter of the projecting rim 28, which forms the external periphery of the rotary actuating knob 26, is adapted to the external diameter of the groove 13 substantially without clearance, and this projecting rim 28 is guided so as to be rotatable in the groove 13. The groove 13 has stops 14, 15 to limit rotation and which are formed by end surfaces of an annular section 13*a* which corresponds to approximately half the periphery of the groove and has an increased radial width. A projecting stop 29 which is fixed on the projecting rim 28 of the rotary actuating knob 26 is fitted into the widened annular section 13*a* of the groove 13 in such a way that it comes to rest against one of the two rotation-limiting stops 14 or 15 when the rotary actuating knob 26 has reached one of its two rotational end positions, namely the completely open position or the completely closed position. The length of the annular sections 13*a* extending in the peripheral direction does not necessarily have to correspond to half the circumference, but is always adapted to the necessary size of rotation.

The rotary drive wheel 4, which is rotatably guided centrally in the housing 1, has a journal pin 24 which projects outwards and upwards on the upper side of the wheel and facing away from the tangs 22, 23. In the region of its free end the journal pin 24 is constructed in the form of an external square 25 and is provided with an axial threaded bore. The rotary actuating knob 26 has a square recess in its center which receives the external square 25 so that the rotary actuating knob 26 and the rotary drive wheel 4 are connected to each other and fixed against relative rotation. The actuating knob 26 mounted on the journal pin 24 of the rotary drive wheel 4 is also firmly secured to the journal pin 24 by a screw 27 and thus also is secured to the rotary drive wheel 4.

Figure 2:
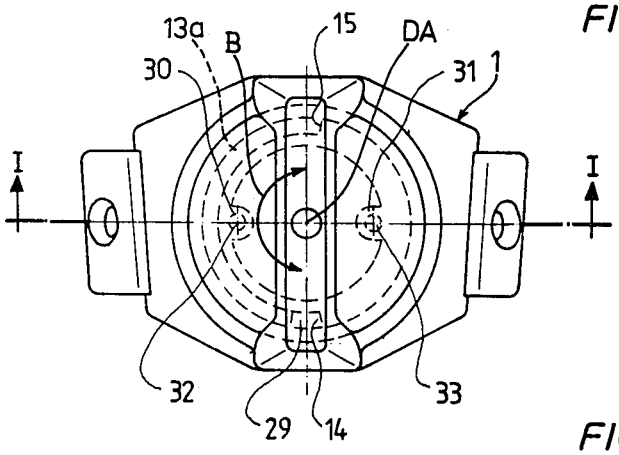
FIG. 2 is a plan view of the closure.

As shown in FIGS. 1 and 2, at least two stops 16, 17 of spherical segment shape project upwards from the flat surface 12 of the upper housing wall 10, and in the illustrated embodiment these stops are approximately diametrically opposed on the surface 12. Two approximately diametrically opposed flat raised areas 30, 31 are provided, integral with the rotary actuating knob 26, inside the projecting rim 28 on the side of the rotary actuating knob 26 facing the closure housing 1, and these raised areas slide along the flat surface 12 of the upper housing wall 10 when the rotary actuating knob 26 is rotated (in the directions of the doubleheaded arrow B). A recess 32, 33 of spherical segment shape corresponding to the projecting stops 16, 17 is formed in each of the raised areas 30, 31, and these recesses 32, 33 cooperate the stops 16, 17 in such a way that in each rotational end position, both in the open position and in the closed position, at least one recess 32 or 33 engages with a corresponding stop 16 or 17 respectively.

To enable the rotary actuating knob 26 to be rotated without difficulty in one or the other direction (arrow B) in order to open and close the closure of the relevant shoe (especially a ski boot), the rotary actuating knob 26 has on its upper surface facing away from the front housing wall 10 a strong, raised gripping part 34 which extends diametrally and has a stepped bore 35 to receive the screw 27 in its center. As shown in FIG. 1, the upper approximately cylindrical end of this stepped bore 35 can be filled by a small cylindrical stopper 34*a* or the like above the screw 27 so that the upper surface of the gripping part 34 is completely smooth and closed.

The actuation of this shoe closure should be largely comprehensible from the above explanation and the illustrations in FIGS. 3 and 4, in which FIG. 3 shows the completely open position and FIG. 4 shows the completely closed position of the closure. They also show that the tangs 22, 23 are always in form-locking driving engagement with the relevant groove 18 or 19 in the corresponding end of a pull strap in every closure position (that is in the open and the closed positions and in every intermediate position). In this embodiment it is also particularly advantageous if the pull strap ends have a recess 20, 21 in the shape of a circular segment or syncline (see FIG. 3) corresponding to the diameter of the tangs 22, 23 on the opposing longitudinal latch edges of the said pull strap ends, and these recesses are made in the regions pointing away from the free strap end with their centers spaced from the grooves 18, 19 also provided therein for engagement with the tangs, their center-to-center distance corresponding to the center-to-center distance of the two tangs 22, 23 which are diametrically opposed on the rotary drive wheel 4. In the completely closed position of the straps 2, 3 (or of the closure), a groove 18 or 19 and a recess 20, 21, respectively thus lie exactly opposite one another so that the relevant tang 22 or 23 respectively is received partially in the groove 18 or 19 respectively and partially in the opposing recess 20 or 21 respectively. Thus, in the closed position an additional lock is provided which prevents the closure from being forced open by the straps 2, 3.

The closure described above can be made from any suitable material which is sufficiently stable. As regards stability and manufacture, however, it is generally preferable for the rotary drive wheel 4 and the tangs 22, 23 mounted thereon to be produced from high-grade steel; the pull straps 2, 3 to be made from metal, preferably sheet steel; and the closure housing 1 and the rotary actuating knob 26 from a suitable sufficiently stable plastics material. In order to ensure reliable guiding inside the parts made from plastics material in this embodiment it is also advantageous to insert a metal bush into the stepped bore 35 of the rotary actuating knob 26 while an approximately plate-shaped metal insert 37 with a square hole for the external square 25 is inserted in the lower portion of the rotary actuating knob which receives the external square 25 of the journal pin 24 (FIG. 1).

What is claimed is:

1. A closure for a ski boot or the like having a pair of pull straps adapted for connection at corresponding ends to parts of the boot and an actuating member rotatable about an axis having two driving members arranged eccentrically with reference to the axis of rotation of the actuating member is characterized in that:

a. the width of the opposite ends of the pull straps is about one-half the width of said corresponding ends thereof extend alongside and adjacent to each other;

b. each of said pull straps has a groove in its narrower end which is open towards the other pull strap and has a depth corresponding to the eccentricity of the driving members; and c. the driving members of the actuating member are accommodated in the grooves.

2. A closure according to claim 1 including a housing having a channel in which each of said pull straps is guided, the width of said channel corresponding substantially to the larger width of each of said straps, a portion of each of the straps being at all times in said channel.

3. A closure according to claim 1 wherein each of said driving members projects approximately axially from one side of a rotary drive wheel forming part of the actuating member, said drive wheel having a journal pin which projects outwards in a direction away from said driving member.

4. A closure according to claim 3 including a housing through which said journal pin extends, said pin being square externally at least in the region thereof which extends through the housing, said pin having a threaded bore therein.

5. A closure according to claim 4 including a rotary actuating knob arranged on said housing and having a square recess in its centre which receives the square region of the journal pin and connects the latter to the rotary drive wheel.

6. A closure according to claim 5 wherein said housing has a substantially flat surface wall facing the rotary actuating knob, said wall having a circular groove formed therein, said rotary actuating knob having a circular projecting rim accommodated in said groove and having an external diameter corresponding substantially to the external diameter of the groove.

7. A closure according to claim 6 wherein said wall has stops and wherein said knob has a projection engageable with said stops to limit rotation of said knob.

8. A closure according to claim 5 wherein said wall has at least two stops of spherical segment shape which project upwards from said flat surface, and wherein said knob has at least two recesses of spherical segment shape confronting said surface for receiving said stops.

9. A closure according to claim 1 wherein each of said pull straps has a recess for the accommodation of said driving members, the centre-to-centre distance between said driving member corresponding to the centre-to-centre distance between the two driving members.

10. A closure according to claim 1 including a housing having on one side thereof a curved wall adapted to the shoe, said housing having guide channels therein for the pull straps and said pull straps having a corresponding curvature.

* * * * *